United States Patent [19]

Pennell

[11] 4,127,272

[45] Nov. 28, 1978

[54] PORTABLE SOCCER GOAL

[76] Inventor: Gordon G. Pennell, 9417 Daryl Dr., Kalamazoo, Mich. 49002

[21] Appl. No.: 780,686

[22] Filed: Apr. 19, 1977

[51] Int. Cl.[2] ..... A63B 63/00

[52] U.S. Cl. ..... 273/102 R

[58] Field of Search ..... 273/95 R, 95 H, 102 R, 273/127 R, 127 B, 127 D

[56] References Cited

U.S. PATENT DOCUMENTS

| | | | |
|---|---|---|---|
| 2,077,343 | 4/1937 | Oakes et al. | 273/127 B |
| 2,256,555 | 9/1941 | Foltin et al. | 273/127 R |
| 2,827,295 | 3/1958 | Austin | 273/127 B X |

FOREIGN PATENT DOCUMENTS

| | | | |
|---|---|---|---|
| 945,760 | 1/1964 | United Kingdom | 273/127 R |

*Primary Examiner*—William H. Grieb

[57] ABSTRACT

A portable soccer goal which can be disassembled into compact linear units for easy transport. The framework comprises two collapsible triangular end supports and a sectional crossbar, with the crossbar attached to the end supports in a pivotal arrangement so as to facilitate assembly of the goal.

5 Claims, 1 Drawing Figure

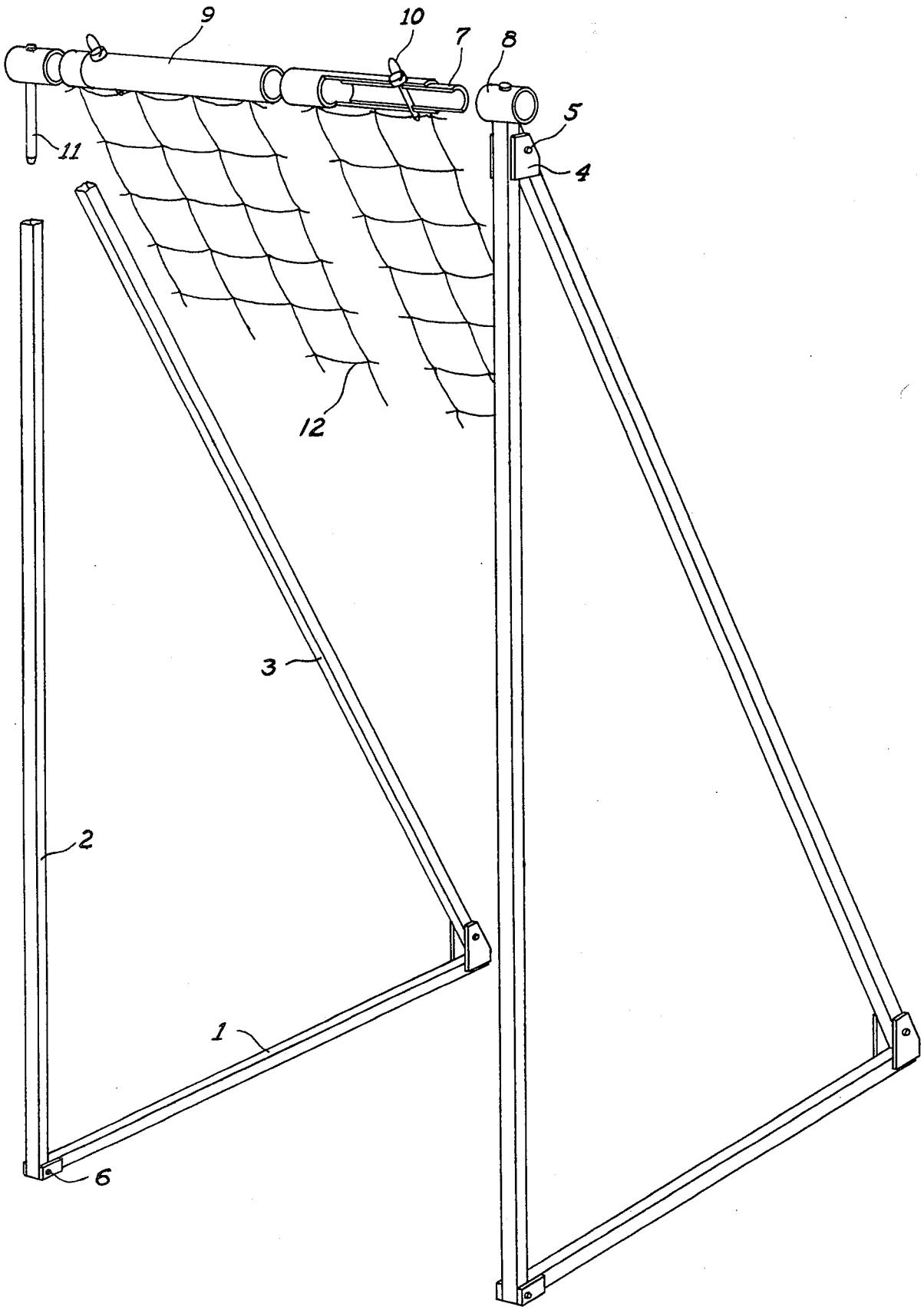
9
10
7
8
5
4
11
12
3
2
1
6

PORTABLE SOCCER GOAL

BACKGROUND OF THE INVENTION

Soccer goals, placed at each end of the playing field, are 24 feet across between the upright posts, and 8 feet high to the crossbar, according to the regulations of the Federation International de Futbol (FIFA). The goal is customarily constructed of heavy 2 to 5 inch steel pipe imbedded in the ground for stability.

In the United States, soccer is still a minor, albeit rapidly-growing, sport. The number of playing fields with permanently installed goals is limited, therefore, forcing many interested players to play without goals or to use improvised ones.

SUMMARY OF THE INVENTION

The present invention discloses the design of a soccer goal which is collapsible and can therefore be easily transported to and from the playing field. The advantageous features of this design are:

(a) Disassembled, the goal collapses into linear units easily carried by one person and of suitable size to be transported in a common vehicle, such as a station wagon or pick-up truck.

(b) The goal can be assembled or disassembled in minutes by two people of no more than ordinary mechanical ability.

(c) The goal can be completely assembled with all parts lying horizontally on the ground, then easily positioned by swiveling the end units up and using them as levers to attain vertical placement.

(d) The weight of the goal is distributed toward the front so that a player or ball striking the front will not knock it over.

DESCRIPTION OF THE DRAWING

The framework of this soccer goal comprises two triangular end supports, and a crossbar. Each end support is made from three pieces of tubular material (1, 2, and 3) attached so as to form a right triangle. The corners of the triangle are secured with pivot plates (4) permanently fastened to one member of the triangle and attached to the adjacent member with a bolt or screw (5). The triangular unit is collapsible by taking out the clip pin (6) at the right angle corner, then pivoting the horizontal (1) and vertical (2) members to a position adjacent to the hypotenuse member (3), providing a compact linear unit.

The crossbar is made up of sections of uniformlysized tubing connected by means of interior sleeves (7) permanently attached to one section (8) and inserted into the adjacent section (9) and fastened with a pin (10).

At each end of the crossbar is affixed at a right angle to the crossbar a length of pipe (11) which will fit snugly into the top of the vertical member (2) of the triangular unit. This means of attaching the crossbar to the end units allows the entire goal to be assembled flat on the ground, after which the triangular end units are rotated 90° upward and then used as levers to bring the entire goal into proper position.

The net (12) is attached to hooks on the crossbar and draped along the hypotenuse member (3) of the triangular end unit, then staked at the base. The forward weight distribution and the net staked at the base lend stability to the goal on the field.

I claim:

1. A portable soccer goal, comprising:

(a) a crossbar which can be disassembled into a plurality of sections for portability;

(b) two collapsible triangular end supports with hinge fasteners on two corners and a pin fastener on the third;

(c) pivotal means of attaching said crossbar and said end supports which allows the end supports to swivel on a length of pipe attached to the crossbar, thereby facilitating assembly of the goal.

2. A portable soccer goal, as recited in claim 1, in which each triangular end support comprises three lengths of tubular material attached to make a right triangle, with the right angle between the horizontal and vertical members and the hypotenuse toward the rear when the goal is in position.

3. A triangular end support, as recited in claim 2, with members attached to each other in such a way that when the pin fastener on one corner is removed, the hinge fasteners on the other corners permit the triangular unit to be collapsed into one linear piece.

4. A portable soccer goal, as recited in claim 1, in which the means of attaching crossbar to end support is a length of pipe of which one end is attached at a right angle to the crossbar, and the other end slips into the upright member of the triangular end support.

5. A portable soccer goal, as recited in claim 1, in which the sections of the crossbar are joined by means of an interior sleeve fastened to one section and slipping into the adjacent one, being then secured with a pin.

* * * * *